US008028856B2

(12) United States Patent
Erdélyi et al.

(10) Patent No.: US 8,028,856 B2
(45) Date of Patent: Oct. 4, 2011

(54) DEVICE FOR THE PACKAGING AND DISPENSING OF SOLID SHAPED BODIES, ESPECIALLY ORAL TABLETS OR AND CAPSULES

(75) Inventors: Zoltán Erdélyi, Széekesfehérvár (HU); Zoltán Bencz, Veresegyház (HU); János Mezei, Budapest (HU)

(73) Assignee: CHINOIN Gyógyszer és Vegyészeti Termékek Gyára Zrt., Budapest (HU)

( * ) Notice: Subject to any disclaimer, the term of this patent is extended or adjusted under 35 U.S.C. 154(b) by 719 days.

(21) Appl. No.: 12/088,993

(22) PCT Filed: Sep. 26, 2006

(86) PCT No.: PCT/HU2006/000083
§ 371 (c)(1),
(2), (4) Date: Aug. 15, 2008

(87) PCT Pub. No.: WO2007/039779
PCT Pub. Date: Apr. 12, 2007

(65) Prior Publication Data

US 2009/0120953 A1 May 14, 2009

(30) Foreign Application Priority Data

Oct. 5, 2005 (HU) ..... 0500919

(51) Int. Cl.
*B65D 83/04* (2006.01)

(52) U.S. Cl. ..... 221/269; 221/268; 221/272; 221/276; 221/264; 221/255

(58) Field of Classification Search ..... 221/233–235, 221/255–256, 263–264, 268–269, 272, 276
See application file for complete search history.

(56) References Cited

U.S. PATENT DOCUMENTS 1,889,232 A * 11/1932 Ware ..... 221/64
(Continued)

FOREIGN PATENT DOCUMENTS

DE 296 01 693 U1 5/1996
(Continued)

OTHER PUBLICATIONS

PCT International Search Report for PCT/HU2006/000083, mailed Jan. 24, 2007.

*Primary Examiner* — Mark A Deuble
(74) *Attorney, Agent, or Firm* — Finnegan, Henderson, Farabow, Garrett & Dunner, L.L.P.

(57) ABSTRACT

The invention relates to a device for the packaging and dispensing of solid shaped bodies, especially oral tablets or/and capsules, which device has a container sealed with a cap suitable for storing shaped bodies, a dispensing opening, and tools forwarding the shaped bodies from the inside of the container to the dispensing opening. The container (5) is constructed in a house (1) in a way that it can be moved like a piston against elastic returning force. The dispensing opening (35) is situated in the bottom (2*a*) of the house (1); when the device is in a position when it is not used for dispensing, the end-part of the container (5), with an opening (20) for releasing one shaped body at a time situated opposite the end of the container (5) sealed with a cap, fits into the dispensing opening (35) by sealing it, and it is constructed in a way that in the course of the dispensing operations it makes it possible to dispense favourably one shaped body at a time outside of the house (1).

17 Claims, 7 Drawing Sheets

U.S. PATENT DOCUMENTS

| | | | | |
|---|---|---|---|---|
| 4,194,647 | A * | 3/1980 | Spurrier | 221/97 |
| 4,266,690 | A * | 5/1981 | Holmes et al. | 221/254 |
| 4,354,619 | A * | 10/1982 | Wippermann et al. | 221/263 |
| 5,735,433 | A * | 4/1998 | Power | 221/229 |
| 6,726,058 | B2 * | 4/2004 | Giraud | 221/267 |
| 6,948,634 | B2 * | 9/2005 | Evans et al. | 221/202 |
| 7,073,684 | B2 * | 7/2006 | Decker et al. | 221/63 |
| 2007/0034641 | A1 * | 2/2007 | Huang | 221/269 |

FOREIGN PATENT DOCUMENTS

| | | | |
|---|---|---|---|
| GB | 2 412 369 | A | 9/2005 |
| WO | WO 2005/044702 | A1 | 5/2005 |

* cited by examiner

DEVICE FOR THE PACKAGING AND DISPENSING OF SOLID SHAPED BODIES, ESPECIALLY ORAL TABLETS OR AND CAPSULES

This application is a national stage filing under 35 U.S.C. §371 of International Application No. PCT/HU2006/000083, filed on Sep. 26, 2006, which claims the benefit of priority of Hungarian Publication No. P0500919, filed on Oct. 5, 2005, all of which are incorporated herein by reference.

The invention relates to the packaging and dispensing of solid shaped bodies, especially oral tablets or/and capsules.

Presently all over the world the most common packaging methods used for distributing solid oral drugs are blister packaging and container packaging.

Generally blister sheets made of PVC/PVDC aluminium contain 4-20 tablets or capsules depending on their size, and the drugs are taken out of the sheets and used one by one, so blister sheets represent an appropriately hygienic and pilferage proof solution. However, blister packaging also has disadvantages, such as the relatively high cost level; the fact that in the case of a higher number of tablets (e.g.: above 50) due to the high number of blisters the packaging is too large, and above a certain numbers (e.g.: 100) it is not practical, and the packaging operation cannot be performed with ordinary packaging equipment; due to its matter composition the recycling of the plastic packaging is not possible, and when it is burnt air-polluting hydrochloric acid gas is released; the protection of tablets inside the blister sheet taken out of the box is not solved (they break when they are pressed); finally the products are banal and factual copies, counterfeits of the products, as the conventional blistering production line is available in all pharmaceutical factories.

In the course of the other widely used container packaging procedure with the help of a device designed especially for this purpose the tablets or capsules are counted into special containers made of plastic or glass or metal, and then the containers are sealed with a cap. The advantage of this method is that in the case of a large amounts of packaging containers are relatively cheap, they protect their contents—the drugs—efficiently, they are environment friendly because they can be recycled, but they have the following disadvantages:

- they do not satisfy hygienic requirements, because in the course of dispensing several tablets or capsules may come out at the same time—e.g.: into the palm, onto the table or floor—from the container, and so the products getting out of the container may become physically or/and bacteriologically contaminated;
- after the container is opened for the first time, due to the contact with air or/and humidity the chemical stability of the products may become questionable;
- the guarantee sealed versions of the container packaging method (e.g.: sealing tape or special cap) increase the price of the product;
- at the same time containers without a guarantee seal can be manipulated (refilling, pilferage, deliberate or accidental contamination, etc.);
- users of the given drug, especially elderly people, often fail to seal the container again by putting the cap back on it appropriately, and it happens very often that the drugs are practically continuously in contact with the ambient air.

German utility model specification No.: DE 296 01 693 U1 describes a device for dispensing tablets one by one, which has a house with a bottom containing an opening and a slide fitting into it. At the top it contains an operating head-plate, and at the bottom it contains a dispensing head, which can be pushed out of the house through the bottom opening together with the whole side against spring force, in which case the tablet driven into it is released and drops out of the house. In its position when not used for dispensing this head closes the bottom opening. Ribs and gaps are designed to arrange the tablets situated inside the house and the slide.

Although beside increasing operation safety and simple manufacturing according to the set task this solution was also intended to improve tightness, in reality—as demonstrated by practical experience and comparative measures—the device provides rather little protection against penetrating air and humidity, which is generally not satisfactory to fulfil such requirements prescribed with respect to pharmaceutical products. This device does not contain seals, sealing should be ensured by the structural elements themselves sliding on each other, which, however, is not always satisfactory to realise the desired sealing efficiency.

As for operation safety that can be reached with the known device, it is questioned by the circumstance experienced in practice that in the closed condition of the dispensing head its edge fitting into the bottom opening may move inwards due to unintended pressure, e.g.: pressure exerted by a child, as a result of which the device comes apart into two parts—the house and the slide—, and the tablets stored in it fall out; it represents not only material damage but obvious danger too.

The task to be solved with the invention is to provide a device suitable for the packaging and dispensing of solid bodies, especially oral tablets or/and capsules, which completely fulfils hygienic requirements, eliminates all possibilities of manipulation, that is it is pilferage proof, overcomes the risk of the unintended opening of the device, and prevents any other inappropriate material of a different quality or nature from being filled in the container after it is opened; is simple to use, environment friendly and its production is cost efficient. Furthermore, as compared to presently known similar solutions the device needs to be sealed more efficiently—against air and humidity—, even if for example after removing a guarantee seal it remains in use for a relatively long period after the first occasion of dispensing.

The invention is based on the recognition that the above advantages of the container packaging method can be preserved and its disadvantages can be eliminated, if the tablets/capsules are taken out of the container one by one, by pressing them out, and both the exit point and the joints of the parts of the container assembled from several units in the most favourable way from the aspect of production engineering are created with sealed joints completely excluding air and humidity from the internal space of the container. We also recognised that by choosing the appropriate shape and look of the parts of the device a hook-and-loop fastener guarantee tape—sealing tape—can also be applied in a simple way, without any additional costs.

On the basis of the above recognition, in accordance with the invention the set task was solved with a device suitable for packaging and dispensing solid shaped bodies, especially tablets or/and capsules, which has a container sealed with a cap suitable for storing shaped bodies, a dispensing opening, and tools forwarding the shaped bodies from the inside of the container to the dispensing opening; the container is constructed in a house in a way that it can be moved like a piston against elastic returning force; the dispensing opening is situated in the bottom of the house; when the device is in a position when it is not used for dispensing the end-part of the container with an opening for releasing one shaped body at a time situated opposite the end of the container sealed with a cap fits into the dispensing opening by sealing it, and it is constructed in a way that in the course of the dispensing operations it makes it possible to deliver favourably one shaped a body at a time outside of the house. The device is based on the idea that the house consists of a lower house-part with a bottom containing the dispensing opening and an upper house-part connected to it, the upper end of which contains a thickened head, the lower side of the head contains a tray facing downwards, and when the device is not used for dispensing, the sealing ring extending upwards situated on the outside surface of the container fits into this tray, and the head is designed to restrict the upward movement of the container caused by the elastic force; and in a given case the upper side of the thickened head is provided with a groove and shoulder to accommodate the ring inserted for the purpose of attaching the sealing tape; and its part units are connected to each other with sealed joints against humidity, in a way that between the cap and the container and between the lower house part and the upper house part there is an overlapping joint, while in the position of the device when it is not used for dispensing the external sealing ring of the container made of a flexibly deformable material gets firmly caught in the tray, and the sealing lip of the lower end-part of the container gets firmly caught in the dispensing opening of the house.

Practically a removable sealing tape (guarantee tape) surrounding the end-part of the device protruding from the house when the container is not used for dispensing is attached to the cap forming the cover of the container. It is also favourable, if a spring is connected to the container, which spring leans against the house, favourably against the bottom of the house, and is pressed when the cap is pressed down and the container is moved, and returns the container to its original position when the cap is released from pressure.

A further construction of the device is characterised by that the container moving in the house like a piston has a chamber starting from an upper container part with a larger diameter than the diameter of the chamber determined to suit the dimensions of the shaped bodies to be dispensed, which chamber is suitable for guiding the shaped bodies to the dispensing opening, and the end-part of this chamber fits into the dispensing opening, when the device is not used for dispensing. It is favourable, if a sealing lip practically made of a flexibly deformable material runs along the bottom of the chamber, which sealing lip lies against—practically stretches against—the lateral surface of the dispensing opening constructed in the bottom of the house; and it is also favourable, if the lateral surface of the dispensing opening slants inwards, while the sealing lip slants outwards.

According to a further construction example the internal side of the bottom plate of the chamber, the width of which bottom plate suits the thickness of the shaped bodies—it is wider than them—, forms a guiding surface slanting downwards, and in its continuation a curved guiding surface also slanting downwards is made on the internal surface of the bottom of the chamber.

Another favourable construction of the device according to the invention is characterised by that between the flat slanting guiding surface of the chamber and its curved guiding surface there is a diverting rib favourably horizontally protruding towards the opening of the chamber, and the external end of the diverting rib is situated at a distance from the wall of the house exceeding the width of the shaped bodies to be dispensed; and opposite the lower end of the opening there are practically triangular shaped diverting ribs becoming thinner upwards, starting from the bottom of the house, from the edge of the dispensing opening. Practically the diverting ribs extend to the height of the horizontal diverting rib, and with their slanting diverting surface they come out onto the internal surface of the wall of the house. It may also be favourable, if the flat upper guiding surface of the chamber runs into the lower curved guiding surface with a steeper guiding surface section.

In accordance with a further feature of the invention plate-like ribs laterally spaced with respect to each other, running in a crosswise direction—favourably at right angles—with respect to the longitudinal direction of the chamber extend upwards from the bottom of the house, practically parallel to the longitudinal geometrical central axis of the device; and in the wall of the container in the same line with these ribs there are gaps the width of which exceeds the thickness of the ribs; and the height of the ribs is determined to enable the ribs to go inside the container when it is pressed down and arrange the shaped bodies, for example tablets, therein. It may also be favourable, if the upper part of the container is connected to the chamber with wall-parts slanting downwards, and the gaps are situated in such a wall-part in a way that they extend into the container wall above; and if favourably vertical plates designed to drive the chamber, running along the opposite edges of the dispensing opening parallel to the lateral walls of the chamber extend upwards from the bottom of the house. In the case of disc-shaped tablets generally the house and the upper container part may be cylinder shaped, while the dispensing opening and the chamber fitting into it may have a rectangular cross-section. The whole device may be made of moulded plastic, favourably polyethylene and/or polypropylene, the cap may be made of for example polyethylene, and the house and the container may be made of polypropylene. The cap contains a drying agent, favourably with silica gel content.

Below the invention is described in detail on the basis of the attached drawings showing the device according to the invention and a few partial solutions of it. In the drawings FIG. 1 shows the device in perspective view, in initial position;

Figure 6:
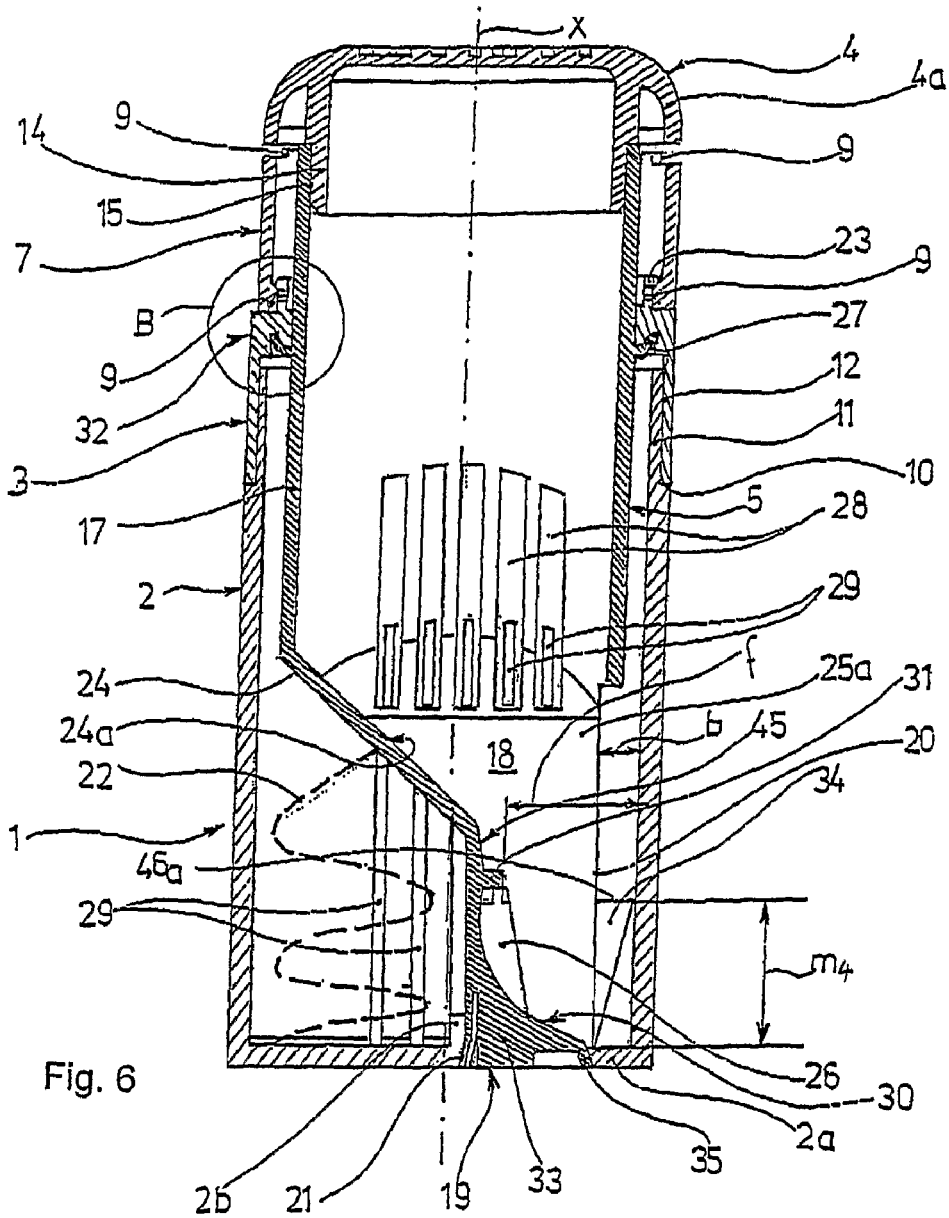
FIG. 6 is a section taken along line A-A marked in FIG. 5.
Figure 5:
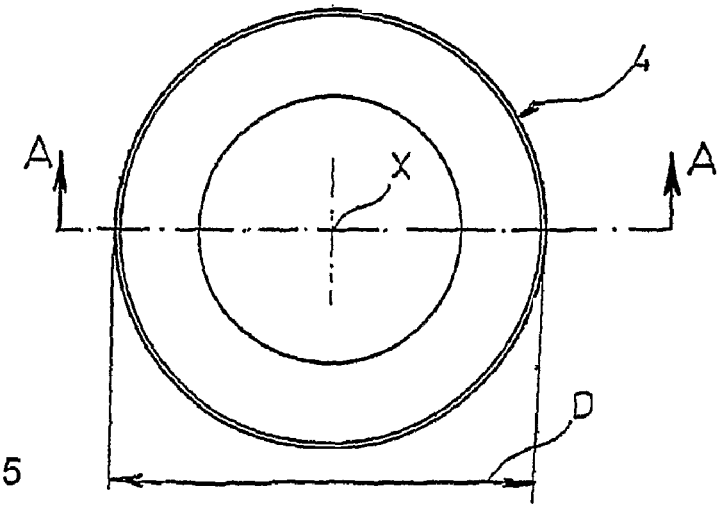
FIG. 5 is the top-view of the device.
Figure 8:
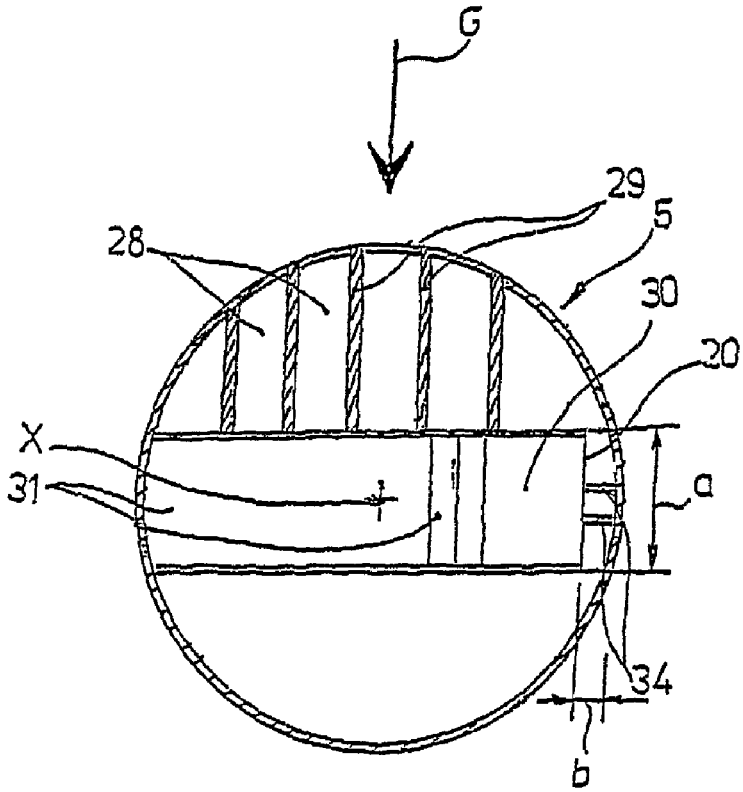
FIG. 8 is a section taken along line F-F marked in FIG. 4.
Figure 9A:
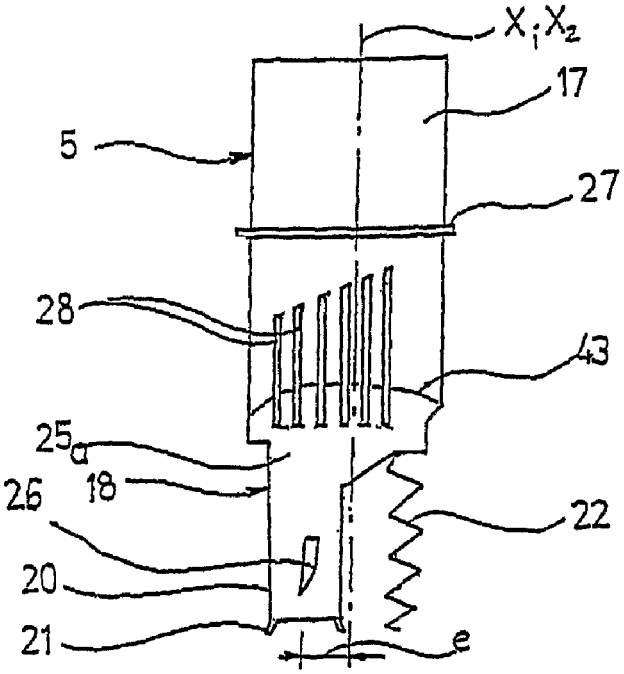
Figure 9B:
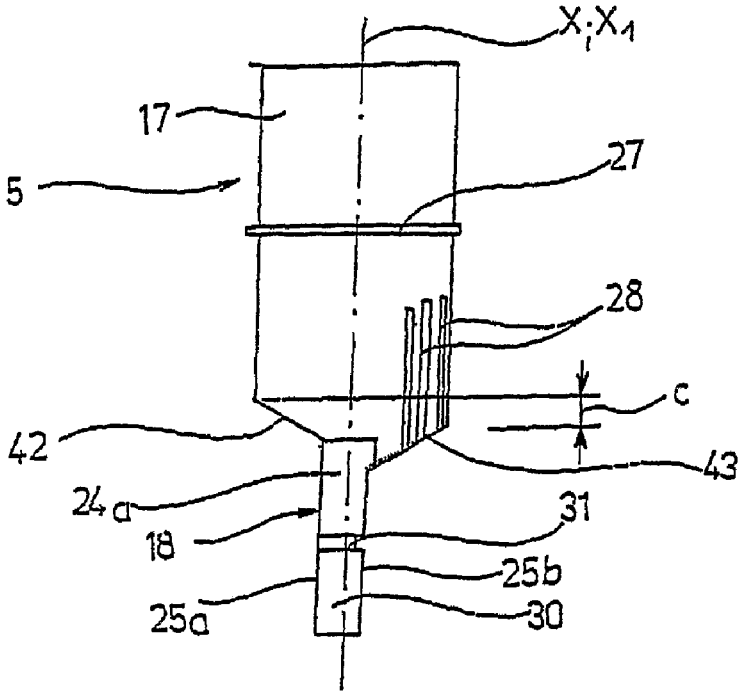
Figure 10:
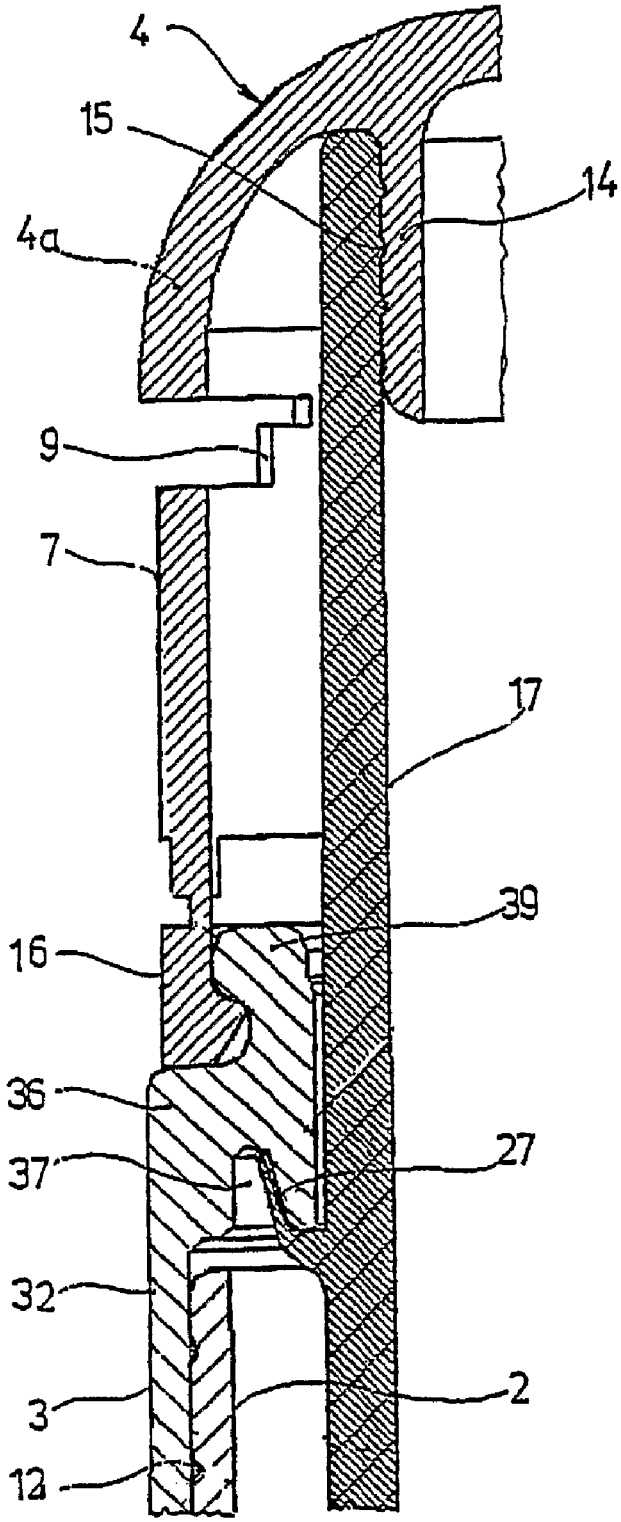
Figure 11:
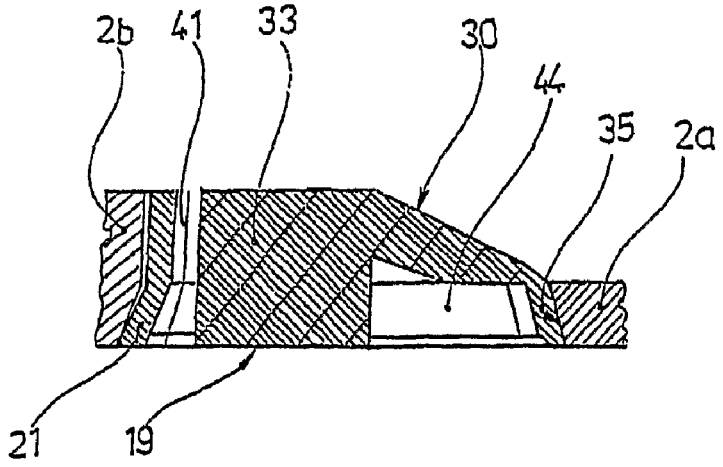
Figure 12:
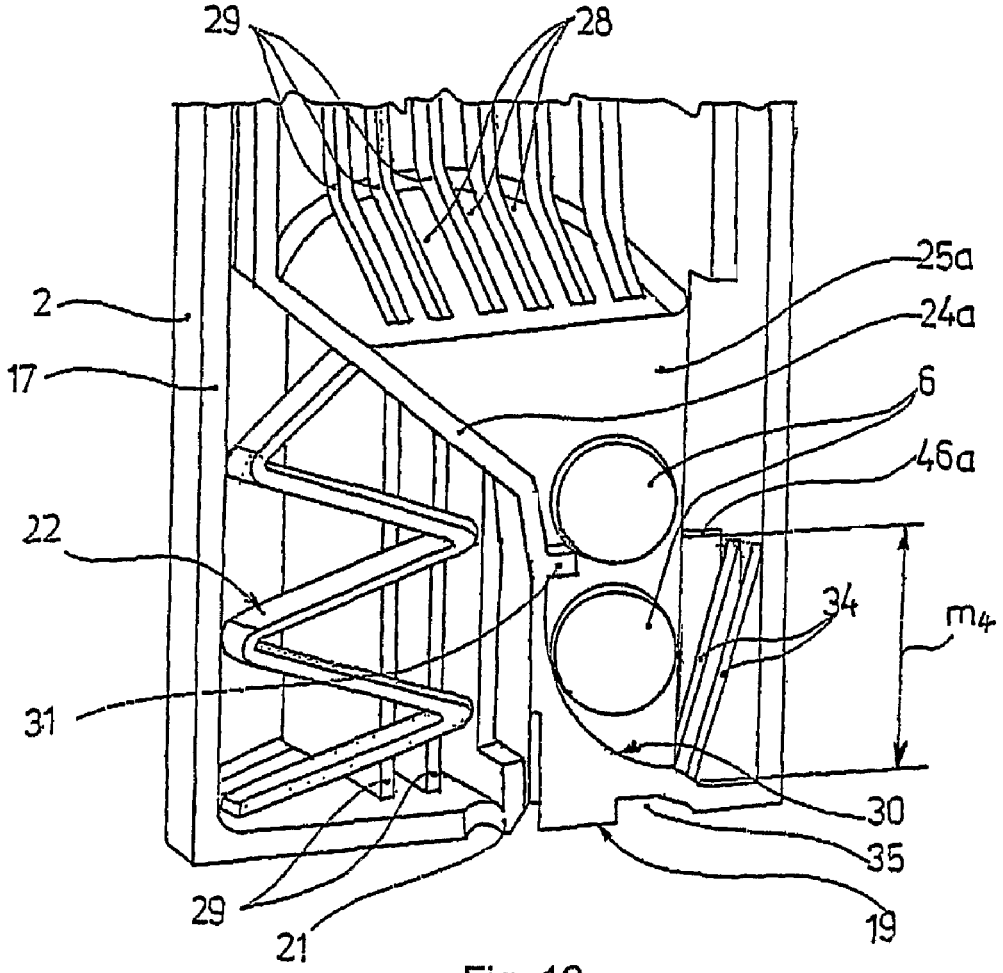
Figure 13:
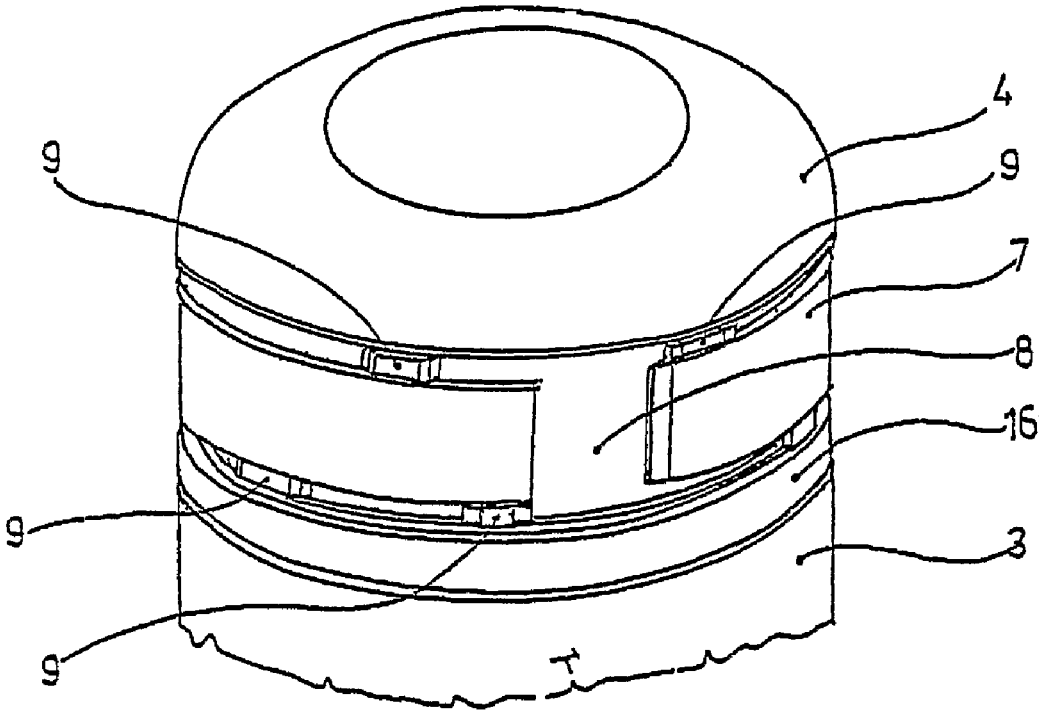
Figure 14:
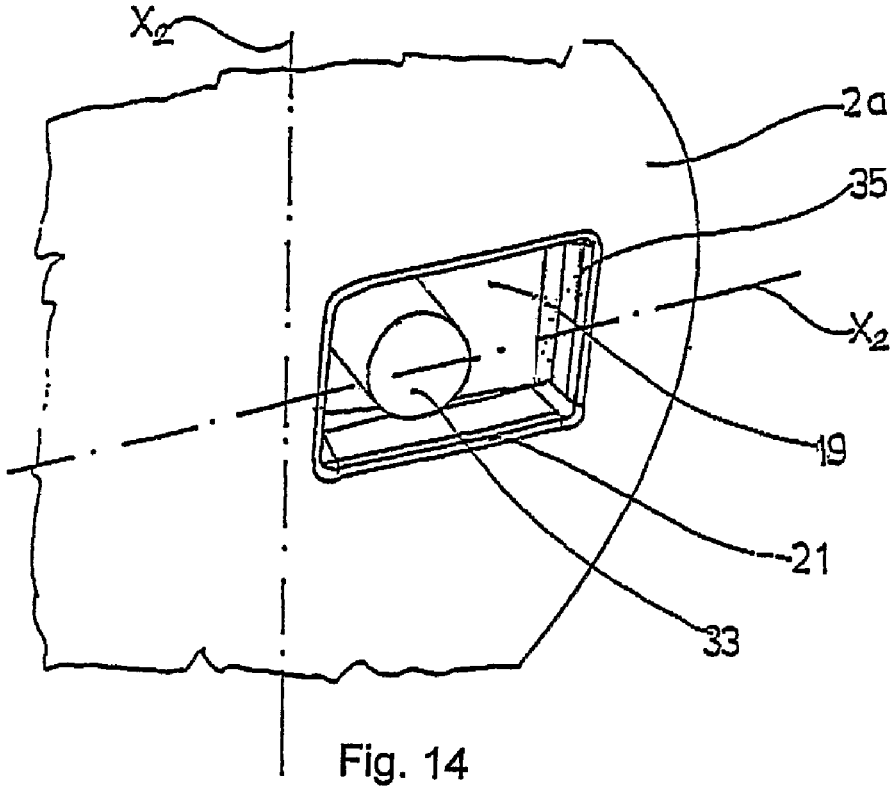

FIG. 9*a* shows a view from the direction of arrow G shown in FIG. 8;

FIG. 9*b* shows the container in a view from the opening of the chamber;

FIG. 10 shows part B marked in FIG. 6 and the part of the device in its continuation, in a larger scale;

FIG. 11 shows part C marked in FIG. 6 on a larger scale;

FIG. 12 shows the lower part of the internal space of the house in perspective view on a larger scale;

FIG. 13 shows the upper part of the house containing the guarantee tape together with the cap on a larger scale;

FIG. 14 shows the bottom of the house in bottom view.

Figure 1:
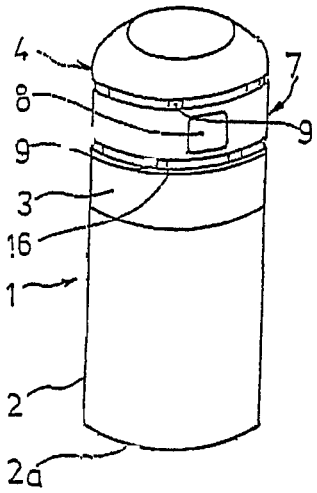
Figure 2:
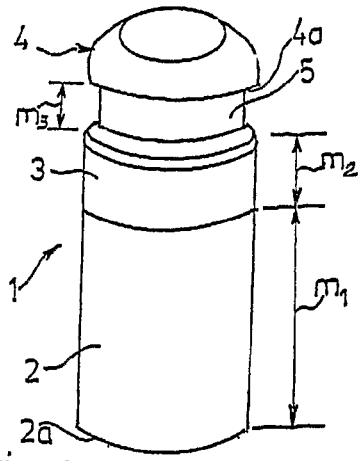
FIG. 2 shows the device as in FIG. 1 in a position ready for dispensing.
Figure 3:
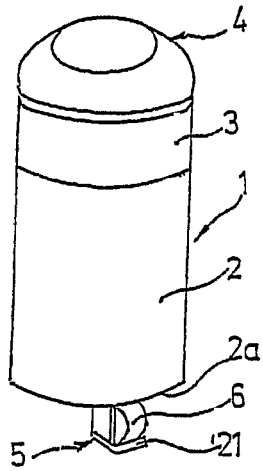
FIG. 3 shows the device as in FIGS. 1 and 2 during dispensing.
Figure 4:
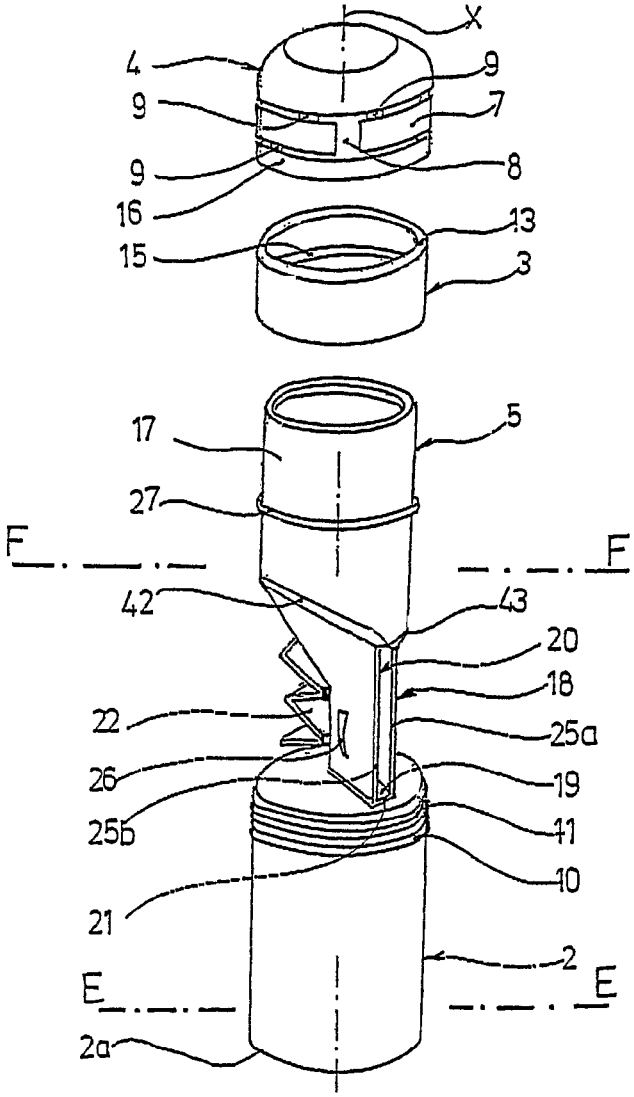
FIG. 4 is an "exploded" perspective drawing of the device.

The construction example of the device according to the invention shown in FIGS. 1-4 has a cylindrical house (body) marked with reference number 1 as a whole, which has lower house-part 2 of a larger height $m_1$ enclosed by a bottom 2*a* at the bottom and an upper house-part 3 of a smaller height $m_2$ (FIG. 2), which house-parts are connected to each other with a humidity impermeable—overlapping joint. In FIG. 4 the longitudinal geometrical central axis of the house 1 is marked with reference letter x. It must be pointed out that the words "lower" and "upper" indicating position refer to the position of the device, in which the opening in the bottom 2*a* through which the tablet 6 can be dispensed as shown in FIG. 3 is situated at the bottom and the cap 4 is situated at the top in space.

A cylindrical container 5 that can be moved to-and-fro like a piston along central axis x fits into the house 1, which container is designed to accommodate the tablets 6 to be stored and dispensed, and at the top it is sealed with a cap 4 (plug) with a sealing tape 7—a pilferage proof guarantee—providing an overlapping joint ensuring sealing against humidity. The container 5 can be moved towards the dispensing opening against an elastic force by pressing the cap 4, and when this pressing force is terminated, it moves back in its initial position. As it will be described in detail later, the lower end-part of the container 5 fits into the dispensing opening in the bottom 2*a* in a humidity impermeable way, that is it prevents humidity from getting to the product situated in the device before dispensing.

In FIG. 1 the device is shown in its initial position—in which it can be distributed—, when the ring-shaped sealing tape 7 also functioning as a guarantee tape prevents it from being opened or operated, and underneath the cap 4 the sealing tape 7 runs all around the upper part extending upwards from the house 1 to an $m_3$ height (FIG. 2)—which is open in the interest of entering the tablets 6 and is only closed with the cap 4—, and with relatively easily removable tabs 9 it is attached to the bottom of the edge 4*a* of the cap on the one part (also see FIG. 6) and to the thin ring 16, which ring lies against the circular shoulder 13 of the upper house-part 3. This tape can be broken at the window 8 in the sealing tape 7, and after the tabs 9—guarantee feet—have been broken, the sealing tape 7 can be removed from its position shown in FIG. 1. This position is shown in FIG. 2; in this case the sealing lip 21 situated at the lower end of the house 5 shown in FIGS. 3 and 4 fits into the already mentioned dispensing opening in the bottom 2*a* in a humidity impermeable way as it is also shown on a larger scale in FIG. 14. It is pointed out that the method of constructing and attaching the cap 4 and the sealing tape 7 is shown in FIG. 13 on a larger scale.

FIG. 3 shows the position of the device during dispensing. The dispensing operation is performed by pressing down the cap 4, as a result of which the lower end-part of the container 5 containing a tablet 6 emerges outside the bottom 2*a*, and a tablet 6 drops out of the device. By terminating the force exposed on the cap 4, due to the already mentioned elastic force the container 5 returns into its position shown in FIG. 2, and the sealed position preventing tablets 6 dropping out is restored.

The dimensions of the house 1 and the container 5—heights $m_1$, $m_2$ and $m_3$ shown in FIG. 2—are determined in a way that the cap 4 needs to be pressed down as far as possible to enable the lower end-part of the container 5 to emerge from the house 1 to an extent allowing only one single tablet 6 to be dispensed.

Below the structural construction of the main parts of the device shown in FIG. 4 and the method of how they are connected to each other is described in detail with reference to large-scale FIGS. 5-12.

The lower house-part 2 has a shoulder 10 running around its upper region and a neck 11 above it containing ring-shaped ribs and indents of a small height running around on the outside, and the upper house-part 3 with similar ribs and indents is connected to the neck 11 with an overlapping joint 12 established after the clicking operation shown in FIG. 6; in this figure the overlapping joint between the neck of the cap 4 extending downwards and the internal upper end of the cylindrical upper container-part 17 of the container 5, which joint is practically identical with the overlapping joint 12, is marked with reference number 15 (also see FIG. 4). As a result of the ribs/indents interlocking with each other the overlapping joints 12 and 15 make it practically impossible to take apart the structural elements belonging to them. The ring 16 makes it possible to place the removable sealing tape 7—guarantee tape—on the container 5 when closing it. Due to the ring 16 the cap 4 can only be taken off the assembled device, if the tabs—guarantee feet—are broken, and by this the device becomes pilferage proof.

The lower part of the container 5 is constructed as a narrow chamber 18, which is closed on three sides and open towards the internal surface of the wall of the house 1 surrounding it and is rectangular-shaped in a section perpendicular to the central axis x, the width of the chamber shown in FIG. 8 is determined to suit the thickness of a tablet 6 (FIG. 3)—it should be wider—, so that the tablet 6 can move downwards in the chamber 18 loosely, without the risk of getting stuck, in a way that its wide lateral surfaces are driven practically in parallel with the parallel side-walls 25*a*, 25*b* bordering the chamber 18. At the bottom the chamber 18 is sealed with a bottom 19 with the already mentioned sealing lip 21 running around it, while the opening 20 of the chamber 18 facing the wall of the house 1 is situated from the surface of this wall at a distance b shown in FIGS. 6 and 8 safely preventing the tablets 6 from moving sideways from the chamber 18 and at the same time enabling the tablets 6 to move loosely without getting stuck (also see FIG. 12). At the bottom the each side-wall 25*a*, 25*b* is penetrated with a curved opening 26 narrowing downwards.

Outside the chamber 18, parallel to it there is a spring 22 (FIG. 9) starting towards the container 5 from the external surface of the narrow slanting wall-part 24 that connects the cylindrical upper container-part 17 with the chamber 18 and is also a part of the chamber 18; the internal slanting guiding surface 24*a* of the wall-part 24 is designed to guide the tablets 6 safely into the lower part of the chamber 18. The shape and geometrical relations of the transitions—joining surfaces—from the cylindrical container part 17 to the chamber 18 with a rectangular cross-section can be seen well especially in FIGS. 4, 9*a* and 9*b*. The chamber 18 is situated in a plane $x_1$ crossing the longitudinal geometrical central axis x—this first $x_1$ plane runs in the middle between the side-walls 25*a*, 25*b*—(FIG. 9*b*), while the slanting guiding surface 24*a* and the curved guiding surface 30 extending downwards as the continuation of the former surface, resulting from their function, are situated in plane $x_2$ at right angles to the already mentioned plane $x_1$ with e eccentricity with respect to the central axis x (FIG. 9*a*). Obviously in the bottom 2*a* of the lower house-part 2 of the house 1 too the dispensing opening 35 is created in accordance with this, see FIGS. 6 and 14. According to FIG. 9*b* the slanting wall-part 42 extends higher by a distance c than the other slanting wall-part 43.

The wall-parts 42, 43 of the container 5, which can be moved like a piston, connected from above on two sides to the narrow chamber 18 of a width of the container 5 (FIG. 8)—to its side-walls 25*a*, 25*b*—also slant upwards, as it can be seen well in FIGS. 9*b* and 4, so they guide the tablets 6 filled into the upper part of the container 5 (FIGS. 3 and 12) downwards, onto the narrower guiding surface 24*a* and the curved guiding surface 30. However, in order to facilitate the arrangement of the tablets 6 moving downwards, in the wall-part 43 there are laterally spaced parallel gaps 28, and in the lower house-part 2 of the house 1 there are ribs 29 extending-upwards from its bottom 2*a* and sliding into the gaps 28 when the cap 4 is pressed downwards. The gaps 28 continue upwards in the wall of the upper container-part 17 of the container 5 and they end at the top, under the sealing ring 27 (see especially FIGS. 6, 9*a*, 9*b* and 12). The position and dimension of cross-section of the ribs 29 (FIGS. 6, 7, 8 and 12) is obviously determined to enable the unobstructed movement of the gaps 28 and ribs 29 with respect to each other when the container moves up and down, and to ensure the effect of this movement guiding the tablets 6.

Figure 7:
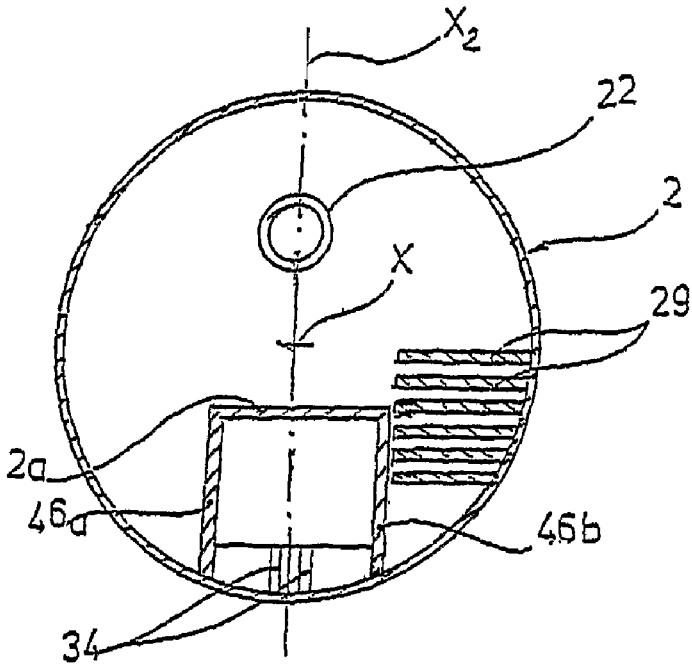
FIG. 7 is a section taken along line E-E marked in FIG. 4.

In FIGS. 6, 7 and 12 it can be seen that along two edges of the dispensing opening 35 situated in the bottom 2*a* of the lower container-part 2 parallel to plane $x_2$ mentioned above there is a short guiding plate 46*a*, 46*b* each, the height of which is marked with reference letter $m_4$ in FIGS. 6 and 12. In the figures mentioned the position of the diverting ribs 34 can also be seen well.

As it can be seen in FIGS. 6, 11 and 12, the bottom 19 of the chamber 18 has a thickened bottom-part, the upper surface of which forms the curved guiding surface 30, and its edges made of a flexibly deformable material slightly bend outwards, and they function as a sealing lip 21 ensuring sealing against humidity by fitting to the surfaces of the dispensing opening slightly bending inwards, which dispensing opening is situated in the bottom 2*a* when the device is sealed. The opening 41 and the hole 44 (FIG. 11) facilitate the movement—fitting—of the lip 21.

As it can be seen in FIGS. 6 and 12, the flat slanting guiding surface 24 of the chamber 18 continues downwards in a much steeper—nearly vertical—short flat guiding surface 45, which ends at a short, practically horizontal diverting rib 31 extending towards the inside of the chamber 18. The external end of the diverting rib 31 running above the bottom 2*a* at an $m_4$ height, which is about one and a half-two times as much as the diameter of the tablets 6, is situated at an f distance from the internal surface of the wall of the container 1, which distance is obviously more than the diameter of the tablets 6, as the diverting rib 31 must not obstruct the downwards movement of the tablets 6. Practically the curved guiding surface 30 starts under the diverting rib 31, and opposite this surface there are the two triangular diverting ribs 34 mentioned above of a shorter height—extending about to the level of the diverting rib 31—narrowing upwards, situated at the same distance from the two sides of the $x_2$ plane, starting from the bottom 2*a* of the lower house-part 2, the external edge of the dispensing opening 35 and extending about to the $m_4$ height of the guiding plates 46*a*, 46*b*.

On the basis of FIGS. 6 and 10 below there is a description of the sealed joint against humidity marked with reference number 32 as a whole in the former figure (FIG. 6, part B), which sealed joint is created between the house 1 and the container 5 that can be moved in the direction of axis. The sealing ring 27 mentioned in connection with FIG. 4 extends upwards, slightly outwards from the external shell surface of the upper container-part 17 of the container 5, and in the sealed position of the device—when it is not used for dispensing—it fits into the V-shaped tray 37 facing downwards on the lower side of the thickened head 36 of the upper house-part 3, and by stretching against its walls it ensures sealing. The fitting of the ring 16 mentioned above fitting into the groove 38 of the edge 39 and supporting against the shoulder 40 can be seen especially well in FIG. 10. It is pointed out that the head 36 functions as a movement restricting element from the aspect of the container 5 moving downwards as a result of the spring force, as after the sealing ring 27 enters the tray 37 and gets caught in it, the container 5 cannot move upwards any more, but when the cap 4 is pressed downwards, it can freely move downwards. So the sealing ring 27 runs along the external side-wall of the upper container-part 17 at a height, and in accordance with this the position of the head 36 is determined in a way that when the force of the spring 22 moves the container 5 downwards it stops when the sealing ring 27 hits the tray 37 exactly when the lower end-part of the container 18 gets into sealing position in the dispensing opening 35. Obviously in FIG. 10 the already mentioned structural elements are marked with the already used reference numbers.

The device is assembled from the parts shown in FIG. 4 in a way that the container 5 is fitted into the lower house-part 2 of the house 1, and then the upper house-part 3 is clicked onto the lower house-part 2; at this point the sealing ring 27 gets caught in the tray 37 shown in FIG. 10. Then a set amount of tablets 6 is filled in the container 5, and the cap 4 with a sealing tape 7—guarantee tape—is clicked into the upper end of the container 5.

The device is operated in a way that—after the sealing tape 7 has been removed from the cap 4—the user holds it in his/her hand, presses the cap 4 with his/her thumb moving by this the container 5 downwards like a piston against the force of the spring 22, the lower end-part—dispensing part—of the chamber 18 emerges from the house 1 through the opening 35, and the tablet 6 at the bottom can drop out of the device. The dimensions of the house 1 and the container 5 are determined and the device is constructed in a way that only one tablet 6 can come out of it at a time. After the tablet 6 is dropped out the user takes his/her thumb off the cap 4 allowing by this the spring 22 to return to its slightly pre-stressed position and to move the container 5 back into its initial position, in which—as described above—the inside of the container 5 is sealed against humidity at all joints, namely at the

- overlapping joint between the cap and the container;
- overlapping joint between the lower and upper parts of the house;
- strained sleeve-joint between the middle part of the container and the upper part of the house; and
- strained sleeve-joint between the lower dispensing end-part of the container and the rectangular-shaped dispensing opening in the bottom of the house.

Before the first use and in the periods between the individual dispensing operations the seal against humidity protects the product inside the device from any deterioration that may be caused by humidity and makes it possible to provide a maximum period of guarantee.

All main parts of the device shown in FIG. 4, including the spring 22, are made of moulded plastic (e.g.: the cap may be made from polyethylene, the container and the house from polypropylene), which has a flexibly deformable nature. The spring 22 and the sealing lip 21 can be made in one piece with the container 5.

The advantageous effects of the invention are the following:

due to the fact that the container can be operated like a piston the device is easy to handle, it is convenient and hygienic, because only one tablet can be dispensed at a time, and the other tablets cannot get contaminated either physically or bacteriologically for example because the tablets get spilt. Inside the container due to the internal structure of the device the completely disorganised set of tablets is arranged in a way that the tablets come out of the device one by one, with their sides parallel to the longitudinal axis of the device, which has not been possible so far in the case of cylindrical containers.

In the known flat containers the arrangement of the tablets results from the geometrical construction of these containers, but as compared to flat containers cylindrical containers have decisive advantages from several aspects, e.g.: their storage capacity, aesthetics, convenience of use, etc. The seal against humidity makes it possible to provide a maximum period of guarantee before the first use; if a product especially sensitive to humidity needs to be stored in the device, the cap having an appropriately sized internal space and connected to the container with a sealed joint can be combined with a drying agent insert containing silica gel. After the device is opened for the first time—and also each time after dispensing a tablet—the device locks itself again automatically. Due to the sealing ring between the house and the container—which also ensures protection against the container and the house being pulled apart—the device remains appropriately sealed against humidity and air even after being used for the first time. The guarantee tape of the cap prevents pilferage, that is it is pilferage proof, and prevents any foreign inappropriate material of a different quality or different nature from being entered into the container after it has been filed; as a secondary function it also prevents any accidental operation that may occur during packaging or transportation. The material of the device is homogenous (polyethylene cap, polypropylene container and house), so it is environment friendly, and its plastic material can be recycled by melting; or it can also be burnt without polluting the environment. The device has the aesthetic shape of a cylindrical tube. Production can take place at a high level, which makes it difficult to copy the device, but even in this case there is no need for complicated, new and expensive packaging equipment: the plastic dispensing container assembled—preassembled—together with the house can be filled in a simple way with the product to be stored and dispensed, e.g.: tablets, and it can be sealed with the plastic cap on the ordinary tube-filling production line without making any modifications to it.

Obviously the invention is not restricted to the construction described in detail above, but it can be realised in several different ways within the scope of protection defined by the claims.

The invention claimed is:

1. A device for the packaging and dispensing of solid shaped bodies, including oral tablets or/and capsules, the device comprising:

a container, sealed with a cap, suitable for storing the shaped bodies;

a dispensing opening; and tools forwarding the shaped bodies from an inside of the container to the dispensing opening;

the container being received in a house, and being configured to move like a piston against an elastic returning force;

the dispensing opening being situated in a bottom of the house;

wherein when the device is in a non-dispensing position, an end-part of the container, having an opening for releasing one shaped body at a time, situated opposite an end of the container sealed with the cap, fits into the dispensing opening by sealing the dispensing opening, and wherein in the course of dispensing operations, one shaped body at a time is dispensed from the house;

wherein the house includes:

a lower house-part with the bottom containing the dispensing opening; and an upper house-part connected to the lower house-part, an upper end of the upper house-part including a thickened head, and a lower side of the head containing a tray facing downwards, wherein when the device is in the non-dispensing position, a sealing ring that extends upwards from an outside surface of the container, fits into the tray, and the head is configured to restrict upward movement of the container caused by the elastic force;

an upper side of the thickened head including a groove and a shoulder to accommodate a ring inserted for the purpose of attaching the sealing tape; and between the cap and the container, and between the lower house-part and the upper house-part, there are overlapping joints configured to seal against humidity;

wherein in the non-dispensing position of the device, the sealing ring of the container, made of a flexibly deformable material, is received in the tray, and a sealing lip of the end-part of the container is received in the dispensing opening of the house.

2. The device of claim 1, wherein the sealing tape is a removable sealing tape, that surrounds the end of the container protruding from the house when the container is in the non-dispensing position, and is attached to the cap forming a cover of the container.

3. The device of claim 1, further including a spring connected to the container, wherein the spring contacts the bottom of the house, and is pressed when the cap is pressed down to move the container, and wherein the spring returns the container to the non-dispensing position when pressure is removed from the cap.

4. The device of claim 1, wherein the container has a chamber starting from an upper container part, having a larger diameter than a diameter of the chamber to suit a dimension of the shaped bodies to be dispensed, and wherein the chamber is configured to guide the shaped bodies to the dispensing opening, and an end-part of the chamber fits into the dispensing opening when the device is in the non-dispensing position.

5. The device of claim 4, wherein the sealing lip runs along a bottom of the chamber, and the sealing lip lies against a lateral surface of the dispensing opening constructed in the bottom of the house.

6. The device of claim 5, wherein the lateral surface of the dispensing opening slants inwards, while the sealing lip slants outwards, such that when the device is in the non-dispensing position, the sealing lip is firmly received in the dispensing opening of the house.

7. The device of claim 4, wherein the chamber includes a bottom plate, a width of the bottom plate being thicker than a thickness of the shaped bodies, and wherein the bottom plate forms a guiding surface slanting downwards, and a curved guiding surface, also slanting downwards, is formed on an internal surface of the bottom of the chamber.

8. The device of claim 7, wherein the chamber has the opening on a side facing an internal surface of the house the opening being situated at a distance from the internal surface of the house, the distance being smaller than a width of the shaped body to be dispensed.

9. The device of claim 7, wherein between the guiding surface of the chamber and the curved guiding surface, there is a diverting rib horizontally protruding towards the opening of the chamber an external end of the diverting rib being situated at a distance from a wall of the house; and wherein opposite a lower end of the opening there are substantially triangular diverting ribs becoming thinner upwards, starting from the bottom of the house, from an edge of the dispensing opening.

10. The device of claim 9, wherein the triangular diverting ribs extend to a height of the horizontal diverting rib the triangular diverting ribs including a slanting diverting surface coming out onto the internal surface of the wall of the house.

11. The device of claim 7, wherein the guiding surface of the chamber runs into the curved guiding surface with a steeper guiding surface section.

12. The device of claim 4, further including plate-like ribs laterally spaced with respect to each other, running in a cross-wise direction with respect to a longitudinal direction of the chamber, wherein the plate-like ribs extend upwards from the bottom of the house, and are substantially parallel to a longitudinal geometrical central axis of the device; and wherein in the wall of the container, aligned with the plate-like ribs, there are gaps, a width of each of the gaps exceeding a thickness of each of the plate-like ribs, and a height of the plate-like ribs being configured to allow the plate-like ribs to go inside the container; and wherein when the container is pressed down, the plate-like ribs arrange the shaped bodies.

13. The device of claim 12, wherein the upper container-part of the container is connected to the chamber with wall-parts that slant downwards, and the gaps are situated in one of the wall-parts in a way that they extend into a container wall above the one of the wall-parts.

14. The device of claim 4, further including vertical plates configured to guide the chamber, running along opposite edges of the dispensing opening parallel to lateral walls of the chamber that extend upwards from the bottom of the house.

15. The device of claim 4, wherein the house and the upper container-part are cylinder-shaped, while the dispensing opening and the chamber have a rectangular cross-section.

16. The device of claim 1, wherein the device is made of molded plastic, including polyethylene and/or polypropylene.

17. The device of claim 1, wherein the cap contains a drying agent insert with silica gel content.

* * * * *

UNITED STATES PATENT AND TRADEMARK OFFICE

CERTIFICATE OF CORRECTION

PATENT NO. : 8,028,856 B2
APPLICATION NO. : 12/088993
DATED : October 4, 2011
INVENTOR(S) : Erdélyi et al.

It is certified that error appears in the above-identified patent and that said Letters Patent is hereby corrected as shown below:

Title Page, Item (54), and in the specifications, column 1, line 3, in the Title, "OR AND" should read --OR/AND--.

Title Page, Item (75), in the Inventors, line 1, "Széekesfehérvár (HU);" should read --Székesfehérvár (HU);--.

In the Claims:

Claim 8, column 10, lines 52-53, "house the opening" should read --house, the opening--.

Claim 9, column 10, line 60, "chamber an external" should read --chamber, an external--.

Claim 10, column 10, line 67-column 11, line 1, "rib the triangular" should read --rib, the triangular--.

Signed and Sealed this
Fourth Day of June, 2013

Teresa Stanek Rea

Teresa Stanek Rea
*Acting Director of the United States Patent and Trademark Office*